US006209666B1

(12) United States Patent
Beccu et al.

(10) Patent No.: US 6,209,666 B1
(45) Date of Patent: Apr. 3, 2001

(54) PERCUSSIVE DOWN-THE-HOLE HAMMER AND A PISTON AND DRILL BIT THEREFOR

(75) Inventors: Rainer Beccu, Houston, TX (US); Bengt Åsberg, Åshammar (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/240,668

(22) Filed: Feb. 2, 1999

(30) Foreign Application Priority Data

Feb. 2, 1998 (SE) ..... 9800283

(51) Int. Cl.[7] ..... E21B 4/14
(52) U.S. Cl. ..... 175/296; 175/92; 173/91
(58) Field of Search ..... 175/296, 92; 173/73, 173/80, 91, 72, 136, 138, 135, 134

(56) References Cited

U.S. PATENT DOCUMENTS 4,819,746 * 4/1989 Brown et al. ..... 175/296
4,878,550 * 11/1989 Chuang ..... 175/296
4,921,056 * 5/1990 Ennis ..... 175/92
5,115,875 * 5/1992 Ennis ..... 175/92
5,131,476 * 7/1992 Harrington ..... 173/17
5,435,402 * 7/1995 Ziegenfuss ..... 175/414

* cited by examiner

*Primary Examiner*—Victor Batson
(74) *Attorney, Agent, or Firm*—Burns, Doane Swecker & Mathis, L.L.P.

(57) ABSTRACT

In an air actuated down-the-hole hammer for rock drilling, a piston reciprocates within a casing to impact against a rear anvil surface of a drill bit. Upon making such impact, some fluid disposed between the impact surface and the anvil surface is forced radially inwardly toward a foot valve which fluidly inner connects central passages extending through the piston and the drill bit. In order to minimize the wear of the foot valve imposed by such forced fluid, either the piston or the drill bit includes a projection extending around a radially inner peripheral edge thereof for deflecting the forced fluid in a direction having an axial component to minimize an impact force of the fluid against the foot valve.

15 Claims, 2 Drawing Sheets

PERCUSSIVE DOWN-THE-HOLE HAMMER AND A PISTON AND DRILL BIT THEREFOR

FIELD OF THE INVENTION

The present invention relates to a percussive down-the-hole hammer and a piston and drill bit therefor.

PRIOR ART

During drilling with down-the-hole hammers under ground, such as in tunnels, the dust generated by the drilling operation often is bound together by the use of water mixed into the pressurized air driving the hammer and flushing the dust away. The down-the-hole hammer is provided with a plastic foot valve located in a central passageway in a drill bit anvil and projecting from the impact surface of the anvil. The foot valve is repeatedly enclosed by a central bore of the reciprocating piston to transfer spent pressurized driving air through the drill bit. When drilling downwardly, water is deposited on the impact surface between successive impacts such that each impact will create a jet stream of water away from the impact surface. The part of the jet stream traveling radially inwardly, however, will cut into the plastic foot valve and finally the valve will break such that the hammer will stop impacting.

OBJECTS OF THE INVENTION

An object of the present invention is to provide a drill bit for a down-the-hole hammer which provide for extended lifespan of the foot valve, Another object of the present invention is to provide a drill bit for a down-the-hole hammer that will have a longer life between service than hitherto known hammers.

These and other objects of the drill bit and the down-the-hole hammer according to the present invention will become apparent from the following detailed description of a preferred embodiment thereof in connection with the accompanying drawings.

SUMMARY OF THE INVENTION

The present invention relates to an air actuated down-the-hole hammer for rock drilling. The hammer comprises a generally cylindrical casing which defines an axis. A drill sub is mounted to a rear end of the casing. A drill chuck is mounted to a front end of the casing. A drill bit is mounted in the drill chuck and includes a front cutting face and a rear anvil portion. The anvil portion includes a rearwardly facing anvil surface. The drill bit includes a first central passageway extending through the anvil surface. A piston is mounted in the casing behind the drill bit. The piston includes a forwardly facing impact surface and a second central passage extending through the impact surface and aligned with the first central passage. A foot valve extends partially in the first central passage and partially in the second central passage when the impact surface impacts the anvil surface, for transferring pressurized air from the second central passage to the first central passage. The piston is mounted for axial reciprocation toward and away from the drill bit, causing the impact surface to impact the anvil surface during a forward stroke of the piston whereby at least some fluid disposed between the impact surface and the anvil surface is forced radially inwardly toward the foot valve. Either the impact surface or the anvil surface includes a projection extending around a radially inner peripheral edge thereof for deflecting the radially inwardly forced fluid in a direction having an axial component to minimize an impact force against the foot valve.

The present invention also relates to a percussive drill bit which includes the projection, and also relates to a piston which includes the projection.

DESCRIPTION OF THE DRAWINGS

The objects and advantages of the invention will become apparent from the following detailed description of a preferred embodiment thereof in connection with the accompanying drawing in which like numerals designate like elements, and in which.

DETAILED DESCRIPTION OF PREFERRED EMBODIMENTS OF THE INVENTION

Figure 1:
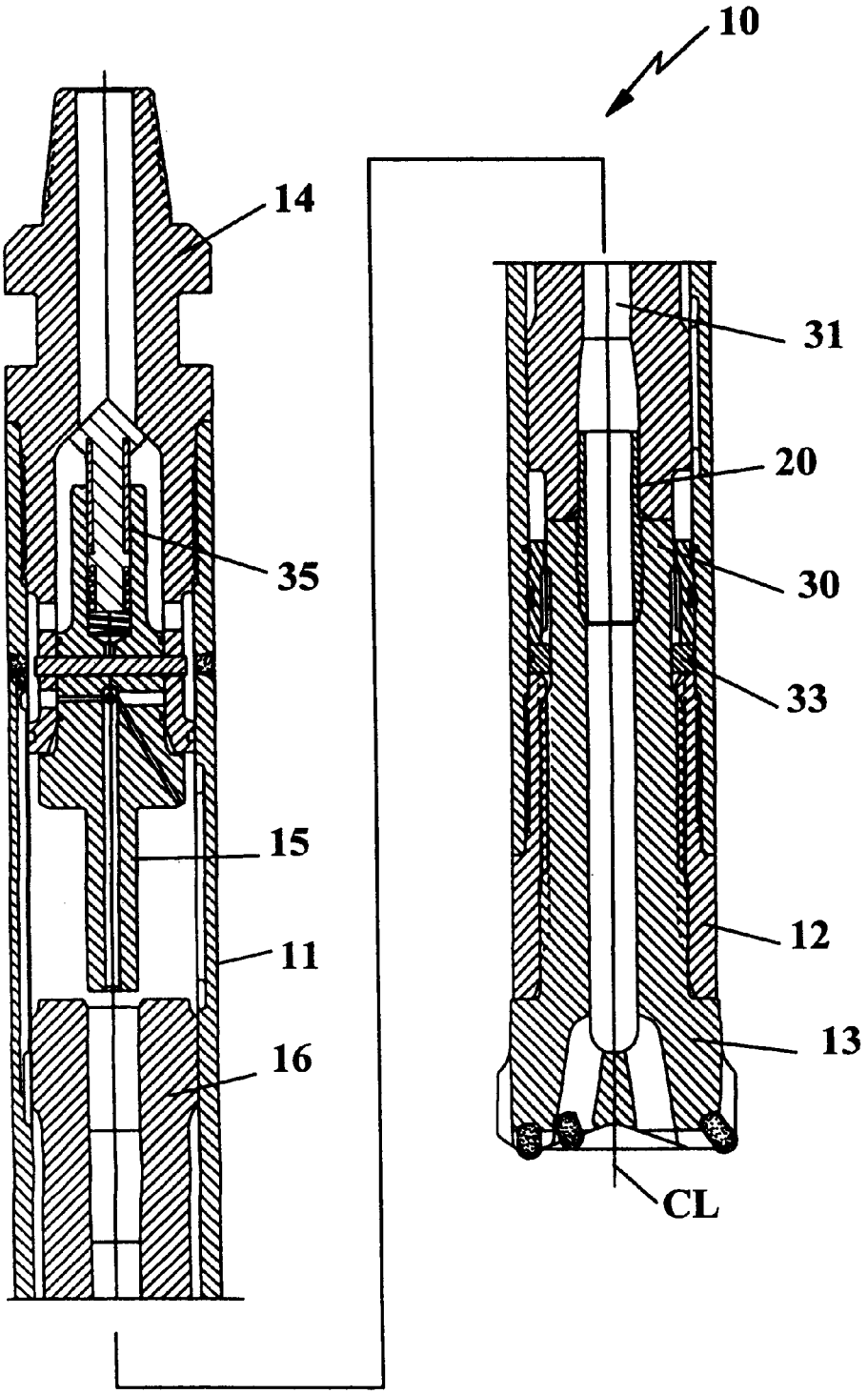
FIG. 1 shows a down-the-hole hammer according to the present invention in a longitudinal section.

In FIG. 1 there is shown a preferred embodiment of a down-the-hole hammer 10 according to the present invention. The hammer 10 comprises an outer cylindrical casing 11 connectable to a rotatable drill pipe string, not shown, through which compressed air is conducted. A hammer piston 16 reciprocates in the cylindrical casing 11, and compressed air is directed alternately to the upper (rear) and lower (front) ends of the piston to effect its reciprocation in the casing, each downward stroke inflicting an impact blow upon the anvil 30 of a drill bit 13 extending upwardly within the lower portion of the cylindrical casing. The piston comprises a passageway 31 for pressurized air. The percussive down-the-hole hammer further comprises a top sub 14, a check valve 35, a control or fluid feed tube 15, a foot valve 20, a retaining means 33 and a driver sub 12. The down-the-hole hammer 10 is of conventional design except for the shape of the anvil 30 of the drill bit 13. Usually the addition of water into the pressurized air for avoiding dust problems amounts to about 4 to 40 liters of water per minute.

Figure 2:
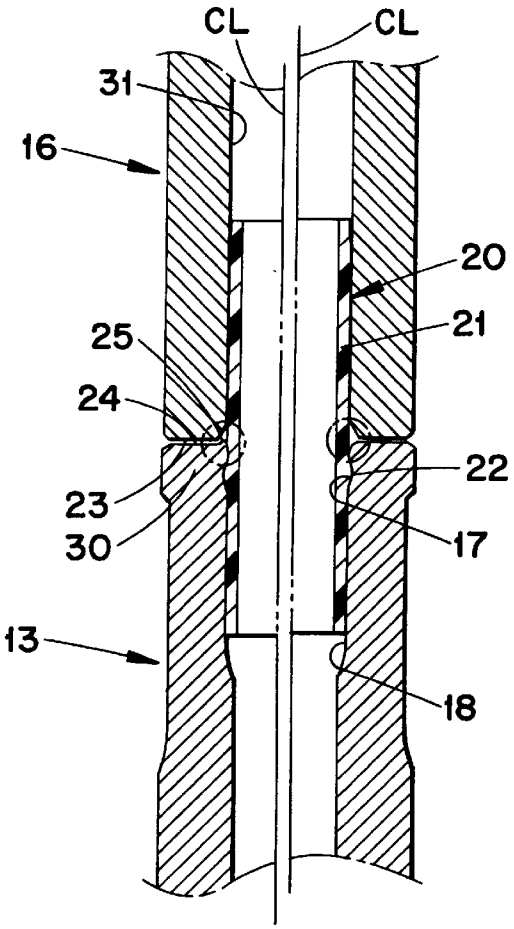
FIG. 2 shows, in the left hand portion of that figure, a foot valve and portions of a drill bit according to the present invention and a piston, in a longitudinal section, and the right hand part thereof discloses a prior art solution.

The foot valve 20 (see FIG. 2) is of generally cylindrical basic shape and is made of plastics, such as nylon. The foot valve comprises a hollow tube 21 provided with a circumferential ridge 22 of a diameter larger than the diameter of the remainder of the tube 21. The ridge 22 is provided to keep the foot valve in the drill bit by being pressed into a corresponding circumferential groove 17 in a drill bit passageway 18. The foot valve 20 extends generally equally far into the drill bit and the piston 16 when the piston front surface 23 (impact surface) impacts on the drill bit rear surface 24 (anvil surface). The impact surface 23 connects to a circumferential chamfer 29 located at the orifice of the passageway 31 of the piston. A center portion of the anvil surface 24 lies in a plane P oriented perpendicular to the axis.

Figure 3:
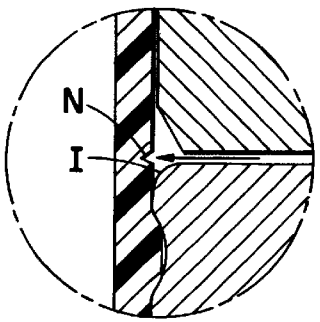
FIG. 3 (PRIOR ART)
FIG. 3 shows an enlarged view of the prior art portion of FIG. 2.

Turning now to the prior art disclosure of FIG. 3, it is previously known to chamfer or smoothen the intersection I of the anvil surface 24 and the drill bit passageway 18. During drilling, when the piston 16 impacts the drill bit, the deposited water on the impact surface will create a jet stream of water, some of which travels in a radially inward direction indicated by the arrow in FIG. 3. That part of the jet stream has an angle of attack of about 90° with respect to the outer surface of the foot valve and will cut into the plastic foot valve (as shown by a notch N in FIG. 3) and finally the valve will break. When the foot valve is broken there will not be any lower chamber present where pressurized air can assemble to lift the piston but instead the air will be transferred immediately through the drill bit passageway 18 and the hammer will not work.

Figure 4:
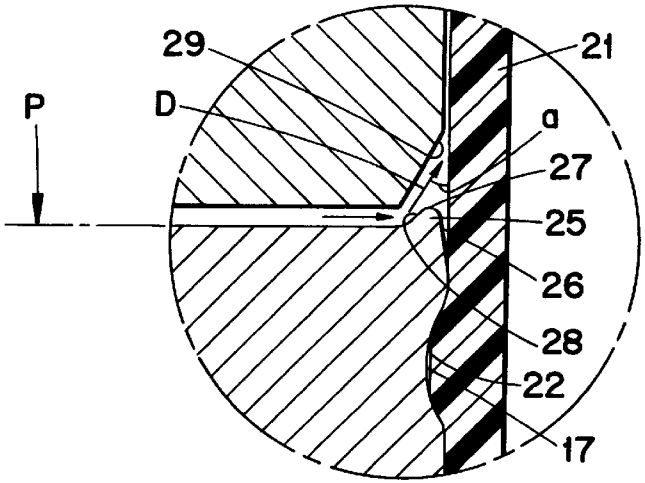
FIG. 4 shows an enlarged view of the left hand portion of FIG. 2 and the drill bit according to the present invention.

Now looking at FIG. 4 there is presented a solution to the problem of jet stream damage to the foot valve. The intersection of the anvil surface 24 and the drill bit passageway 18 is provided with a jet stream deflector in the shape of a circumferential projection or lip 25 integrated with the drill bit 13. The projection 25 extends beyond the plane P. The jet stream of water during drilling will be deflected by the lip 25 in a direction D indicated by the arrow in FIG. 4 in such a manner that the energy of the stream is reduced to about one half. In addition, the attack angle of the stream with respect to the foot valve will be obtuse such that only about half of the remaining energy of the stream is transferred onto the foot valve. The lip 25 can be of many alternative shapes but in the preferred embodiment the lip extends generally parallel to the chamber 29 and has a conical cross-section formed by a radially inwardly facing entrance surface 26, a curved peak 27 and a radially outwardly facing deflection surface 28, whereby the direction D has axially upward (rearward) and radially inward directional components. The deflection surface 28 forms an angle a with the center line CL of the drill bit 13. The angle a is acute and is preferably at least 45°.

A drill bit according to the present invention will provide for an extended lifespan of the foot valve. Furthermore, a down-the hole hammer according to the present invention will have a more reliable function than hitherto known hammers.

Figure 5:
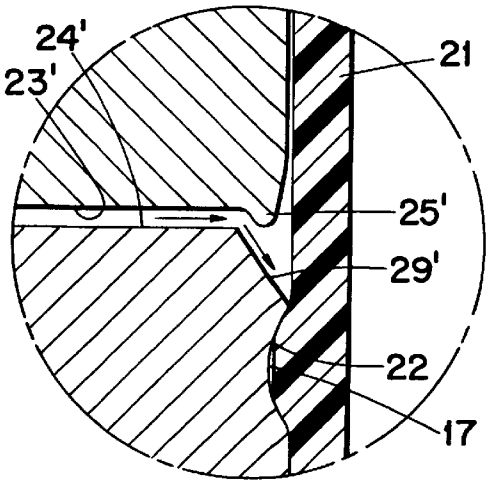
FIG. 5 is a view similar to FIG. 4 showing another embodiment of the invention.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims. For example, the projection 25' could be integrated with the impact surface 23' of the piston and the chamfer 29' formed in the anvil surface 24' of the drill bit, as shown in FIG. 5.

What is claimed is:

1. An air-actuated down-the-hole hammer for rock drilling, comprising:

a generally cylindrical casing defining an axis;

a drill sub mounted to a rear end of the casing;

a drill chuck mounted to a front end of the casing;

a drill bit mounted in the drill chuck and including a front cutting face and a rear anvil portion, the anvil portion including a rearwardly facing anvil surface, the drill bit including a first central passage extending through the anvil surface;

a piston mounted in the casing behind the drill bit and including a forwardly facing impact surface and a second central passage extending through the impact surface and aligned with the first central passage;

a foot valve extending partially in the first central passage and partially in the second central passage when the impact surface impacts the anvil surface for transferring pressurized air from the second central passage to the first central passage;

the piston mounted for axial reciprocation toward and away from the drill bit whereby the impact surface impacts the anvil surface during a forward stroke of the piston and forces fluid disposed between the impact surface and the anvil surface radially inwardly toward the foot valve;

one of the impact surface and the anvil surface including a projection extending around a radially inner peripheral edge thereof for deflecting the radially inwardly forced fluid in a direction having an axial component to minimize an impact force against the foot valve.

2. The hammer according to claim 1 wherein the projection has a generally conically shaped crossection.

3. The hammer according to claim 2 wherein the projection includes a radially outwardly facing surface, a rounded peak, and a radially inwardly facing surface, each of the radially inwardly facing surface and the radially outwardly facing surface extending at an oblique angle with respect to the axis.

4. The hammer according to claim 3 wherein the oblique angle of the radially outwardly facing surface is at least 45°.

5. The hammer according to claim 1 wherein the other of the impact surface and the anvil surface includes a chamber opposing the projection to enable the projection to pass beyond a plane defined by engagement between the impact surface and the anvil surface.

6. The hammer according to claim 1 wherein the projection is on the impact surface.

7. The hammer according to claim 1 wherein the projection is on the anvil surface.

8. A percussive drill bit for use in a down-the-hole hammer, comprising a front drilling face;

a rear anvil surface; and a central passageway extending through the anvil surface along a center axis of the drill bit;

a center portion of the anvil surface lying in a plane extending perpendicular to the axis;

the anvil surface including a projection extending around an inner peripheral edge thereof and projecting rearwardly beyond the plane.

9. The drill bit according to claim 7 wherein the projection has a generally conical cross-sectional shape formed by a radially inwardly facing surface, a radially outwardly facing surface, and a rounded peak interconnecting the radially inwardly facing surface and the radially outwardly facing surface.

10. The drill bit according to claim 9 wherein the radially outwardly facing surface forms an oblique angle with respect to the axis.

11. The drill bit according to claim 10 wherein the oblique angle is at least 45°.

12. A piston for use in a down-the-hole hammer, comprising:

a front impact face; and a central passage extending axially through the front impact face;

a center portion of the impact face lying in a plane oriented perpendicular to a center axis;

the impact face including a projection extending around an inner peripheral edge thereof and projecting forwardly beyond the plane.

13. The piston according to claim 12 wherein the projection has a generally conical cross-sectional shape formed by a radially inwardly facing surface, a radially outwardly facing surface, and a rounded peak interconnecting the radially inwardly facing surface and the radially outwardly facing surface.

14. The piston according to claim 13 wherein the radially outwardly facing surface forms an oblique angle with respect to the axis.

15. The piston according to claim 14 wherein the oblique angle is at least 45°.

* * * * *